US009011113B2

(12) United States Patent
Ma et al.

(10) Patent No.: US 9,011,113 B2
(45) Date of Patent: Apr. 21, 2015

(54) MAGNETIC-FORCE INTERACTIVE FAN

(71) Applicant: Hsiao-Kang Ma, Taipei (TW)

(72) Inventors: Hsiao-Kang Ma, Taipei (TW); Hsien-Chin Su, Tainan (TW); Wen-Fu Luo, Taipei (TW); Wei-Han Ho, Taoyuan County (TW)

(73) Assignee: Hsiao-Kang Ma, Taipei (TW)

( * ) Notice: Subject to any disclaimer, the term of this patent is extended or adjusted under 35 U.S.C. 154(b) by 333 days.

(21) Appl. No.: 13/732,741

(22) Filed: Jan. 2, 2013

(65) Prior Publication Data

US 2014/0017102 A1 Jan. 16, 2014

(30) Foreign Application Priority Data

Jul. 10, 2012 (TW) ..... 101124748 A

(51) Int. Cl.
*F04D 33/00* (2006.01)
*F04B 43/00* (2006.01)
*F04F 7/00* (2006.01)

(52) U.S. Cl.
CPC ..... *F04B 43/0054* (2013.01); *F04D 33/00* (2013.01); *F04F 7/00* (2013.01)

(58) Field of Classification Search
CPC ..... F04B 43/0054; F04F 7/00; F04D 33/00
USPC ..... 417/410.1, 410.2, 436; 361/688, 690, 361/694, 695
See application file for complete search history.

(56) References Cited

U.S. PATENT DOCUMENTS

| | | | | |
|---|---|---|---|---|
| 4,498,851 | A * | 2/1985 | Kolm et al. | 417/410.2 |
| 5,008,582 | A * | 4/1991 | Tanuma et al. | 310/332 |
| 5,522,712 | A * | 6/1996 | Winn | 417/436 |
| 6,043,978 | A * | 3/2000 | Mody et al. | 361/690 |
| 7,621,725 | B2 * | 11/2009 | Huang et al. | 417/420 |

* cited by examiner

*Primary Examiner* — Charles Freay
*Assistant Examiner* — Philip Stimpert
(74) *Attorney, Agent, or Firm* — Muncy, Geissler, Olds & Lowe, P.C.

(57) ABSTRACT

A magnetic-force interactive fan includes a base, a plurality of clamp portions, an actuating portion, a main blade, and at least one interactive blade. The actuating portion has a fixed terminal and a moveable terminal; the fixed terminal is connected to one of the clamp portions. The main blade has a free terminal and a connection terminal; the connection terminal is connected to the moveable terminal of the actuating portion and a main magnet is disposed on the free terminal. The interactive blade has a top terminal and a bottom terminal; the bottom terminal is connected to another clamp portion and an interactive magnet is disposed on the top terminal. The main magnet is disposed corresponding to the interactive magnet and the main blade is driven by the actuating portion to swing, thus producing wind by synchronously swinging the main blade and the interactive blade.

10 Claims, 8 Drawing Sheets

MAGNETIC-FORCE INTERACTIVE FAN

This application is based on and claims the benefit of Taiwan Application No. 101124748 filed Jul. 10, 2012 the entire disclosure of which is incorporated by reference herein.

BACKGROUND OF THE INVENTION

1. Field of the Invention

The present disclosure relates generally to a magnetic-force interactive fan, and more particularly to a magnetic-force interactive fan that synchronously swings blades to produce wind by repulsive magnetic force and elastic force.

2. Description of Related Art

Because electronic products have been developed rapidly in recent years, electronic components are increasingly powerful and size of the electronic components is gradually reduced. However, heat generated from the electronic components per unit area is also getting higher. Traditionally, the heat-dissipating fin and rotary fan are used to solve the problem of heat dissipation, such as for the computer CPU. However, the rotary fan usually occupies larger space and has the problem of noise after used for a long time.

Accordingly, it is desirable to provide a magnetic-force interactive fan that synchronously swings blades to produce wind by repulsive magnetic force and elastic force to overcome the problem of heat dissipation.

SUMMARY OF THE INVENTION

An object of the present disclosure is to provide a magnetic-force interactive fan to solve the above-mentioned problems. Accordingly, the magnetic-force interactive fan includes a base, a plurality of clamp portions, an actuating portion, a main blade, and at least one interactive blade. The clamp portions are separated to each other and installed on the base. The actuating portion has a fixed terminal and a moveable terminal, and the fixed terminal is connected to one of the clamp portions. The main blade has a free terminal and a connection terminal, and the connection terminal is connected to the moveable terminal of the actuating portion. The main blade further has a main magnet disposed on the free terminal thereof. The at least one interactive blade has a top terminal and a bottom terminal, and the bottom terminal is connected to another clamp portion. The at least one interactive blade further has an interactive magnet disposed on the top terminal thereof. The main magnet is disposed corresponding to the at least one interactive magnet and the main blade is driven by the actuating portion to swing, thus producing wind by synchronously swinging the main blade and the at least one interactive blade.

It is to be understood that both the foregoing general description and the following detailed description are exemplary, and are intended to provide further explanation of the present disclosure as claimed. Other advantages and features of the present disclosure will be apparent from the following description, drawings and claims.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

Figure 1:
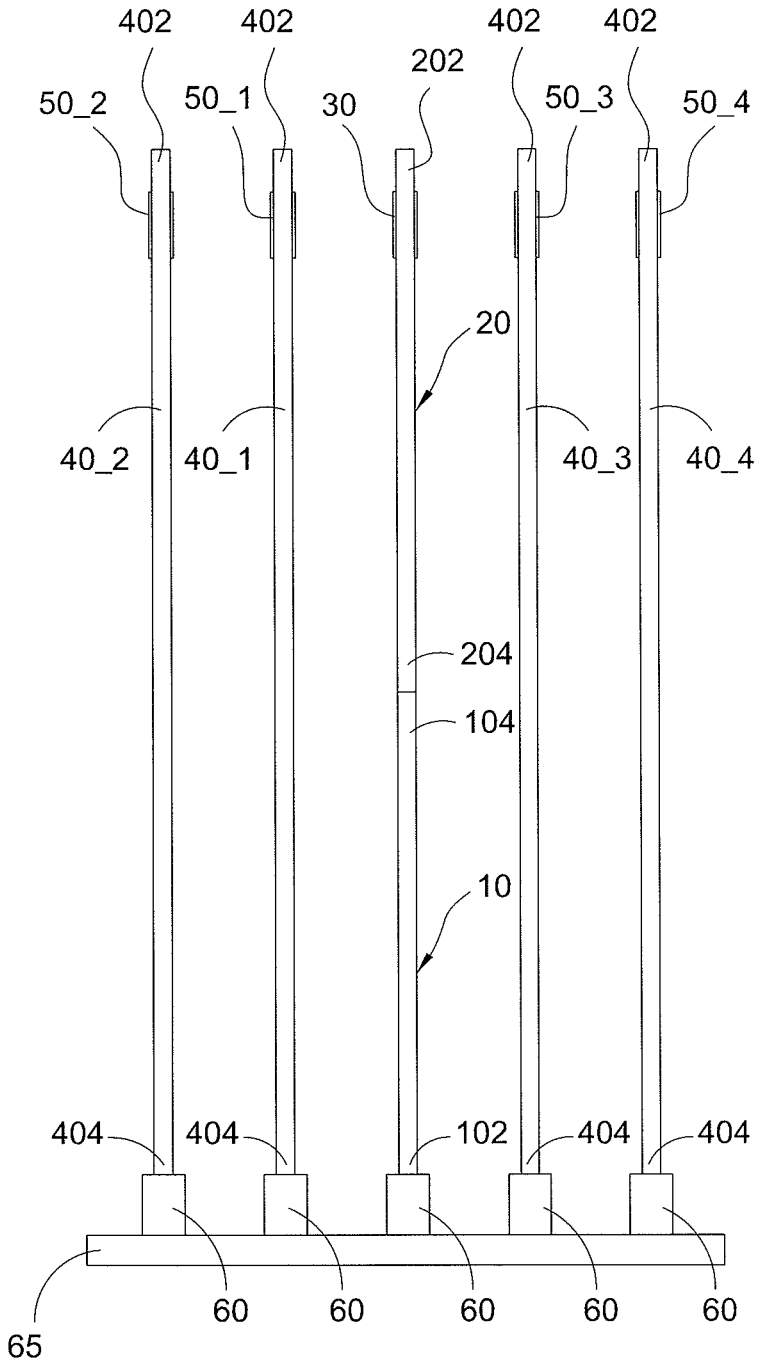
FIG. 1 is a schematic plan view of a magnetic-force interactive fan according to the present disclosure.

Reference will now be made to the drawing figures to describe the present invention in detail.

Reference is made to FIG. 1 which is a schematic plan view of a magnetic-force interactive fan according to the present disclosure. The magnetic-force interactive fan includes a base 65, a plurality of clamp portions 60, an actuating portion 10, a main blade 20, and at least one interactive blade 40. The clamp portions 60 are separated to each other and installed on the base 65. The actuating portion 10 has a fixed terminal 102 and a moveable terminal 104, and the fixed terminal 102 is connected to one of the clamp portions 60. In particular, the fixed terminal 102 of the actuating portion 10 is connected to one of the clamp portions 60 by a locking means, an adhering means, or a clamping means. The main blade 20 has a free terminal 202 and a connection terminal 204, and the connection terminal 204 is connected to the moveable terminal 104 of the actuating portion 10. The main blade 20 further has a main magnet 30 disposed on the free terminal 202 thereof. The at least one interactive blade 40 has a top terminal 402 and a bottom terminal 404, and the bottom terminal 404 is connected to another clamp portion 60. The at least one interactive blade 40 further has an interactive magnet 50 disposed on the top terminal 402 thereof. The connection terminal 204 of the main blade 20 is connected to the bottom terminal 404 of the actuating portion 10 by an adhering means. The bottom terminal 404 of the at least one interactive blade 40 is connected to another clamp portion 60 by a locking means, an adhering means, or a clamping means. In addition, the free terminal 202 of the main blade 20 has a through hole (not labeled) so that the main magnet 30 can be embedded in the through hole of the main blade 20. The top terminal 402 of the at least one interactive blade 40 has a through hole (not labeled) so that the at least one interactive magnet 50 can be embedded in the through hole of the at least one interactive blade 40. However, this embedding means is for demonstration and not for limitation of the present disclosure. That is, the main magnet 30 and the at least one interactive magnet 50 can be directly fixed on the main blade 20 and the at least one interactive blade 40 by an adhering means, respectively. Furthermore, the main blade 20 and the at least one interactive blade 40 can be an elastic piece, such as the polyvinylchloride (PVC), but not limited. The main magnet 30 is disposed corresponding to the at least one interactive magnet 50 and the main blade 20 is driven by the actuating portion 10 to swing, thus producing wind by synchronously swinging the main blade 20 and the at least one interactive blade 40.

Especially, the preferred embodiment of the magnetic-force interactive fan is a magnetic-force interactive piezoelectric fan according to the present disclosure so that the actuating portion 10 is a piezoelectric element, such a piezoelectric patch. The inverse piezoelectric effect of the piezoelectric element is that when an external electric field (voltage) is applied to the piezoelectric element so that the piezoelectric element lengthens in the direction of the electric field, thus converting the electrical energy into the mechanical energy. According to the inverse piezoelectric effect, the actuating portion 10 is supplied by an AC power source to convert the AC power energy into the mechanical energy, thus providing a mechanical actuation. The detailed description of the magnetic-force interactive fan will be made hereinafter with reference to figures.

Figure 2A:
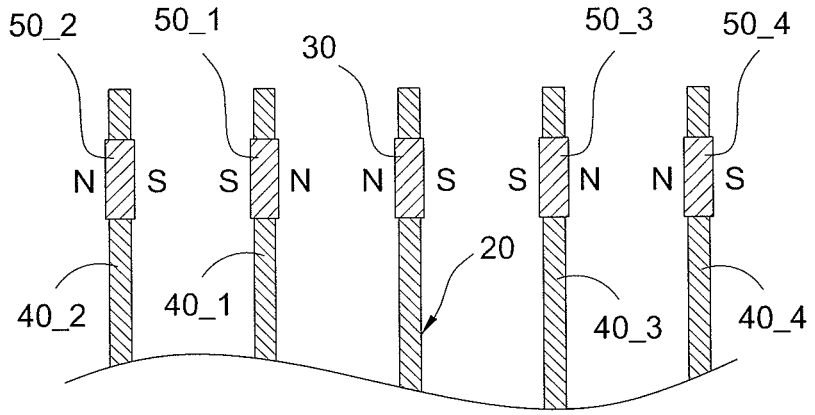
FIG. 2A is a partial schematic view of the magnetic-force interactive fan according to a first embodiment of the present disclosure.

For convenience, it is assumed that there are five clamp portions, four interactive blades, and four interactive magnets as shown in FIG. 1. Reference is made to FIG. 2A which is a partial schematic view of the magnetic-force interactive fan according to a first embodiment of the present disclosure. In this embodiment, the main magnet 30 is disposed on the free terminal 202 of the main blade 20. The four interactive magnets 50 are a first interactive magnet 50_1, a second interactive magnet 50_2 a third interactive magnet 50_3, and a fourth interactive magnet 50_4, respectively. In particular, the first interactive magnet 50_1 and the second interactive magnet 50_2 are arranged corresponding to one side of the main magnet 30. Also, the third interactive magnet 50_3 and the fourth interactive magnet 50_4 are arranged corresponding to the other side of the main magnet 30. In addition, the first interactive magnet 50_1 is disposed on a first interactive blade 40_1, the second interactive magnet 50_2 is disposed on a second interactive blade 40_2, the third interactive magnet 50_3 is disposed on a third interactive blade 40_3, and the fourth interactive magnet 50_4 is disposed on a fourth interactive blade 40_4. Especially, the main magnet 30 and the at least one interactive magnet 50 are correspondingly disposed to each other and the polarities of two adjacent magnets at the corresponding positions are opposite. In this embodiment, it is assumed that the polarity of the main magnet 30 on left is N and on right is S. Hence, the polarity of the first interactive magnet 50_1 on left is S and on right is N, the polarity of the second interactive magnet 50_2 on left is N and on right is S. Similarly, the polarity of the third interactive magnet 50_3 on left is S and on right is N, the polarity of the fourth interactive magnet 50_4 on left is N and on right is S.

According to the arrangement of the main magnet 30 and the interactive magnets 50_1-50_4, the actuating portion (piezoelectric patch) 10 is supplied by the AC power source to provide a mechanical actuation. In addition, because the fixed terminal 102 of the actuating portion 10 is connected to one of the clamp portions 60, the piezoelectric patch is bent toward the left and the right when a voltage difference is produced across two terminals of the piezoelectric patch so that the piezoelectric patch will continuously swing as the AC power source alternatively changes.

Figure 3A:
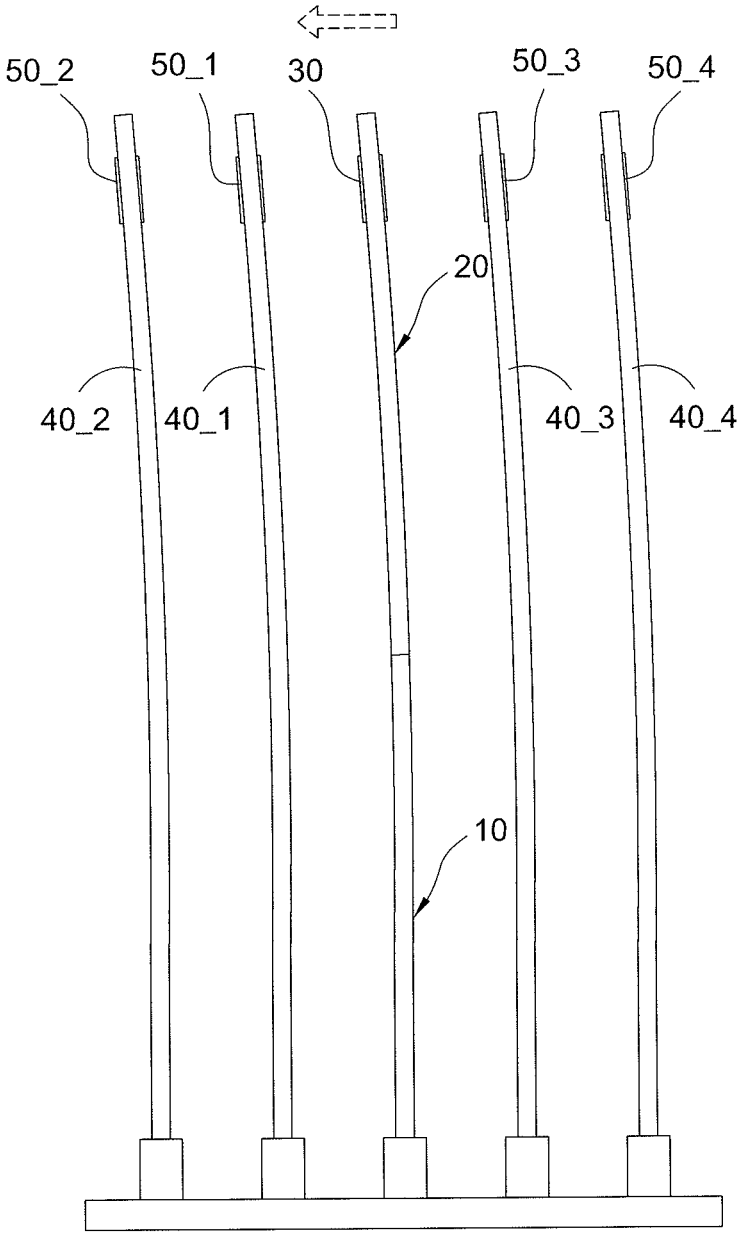
FIG. 3A is a schematic view of driving the magnetic-force interactive fan to swing toward the left according to the present disclosure.
Figure 3B:
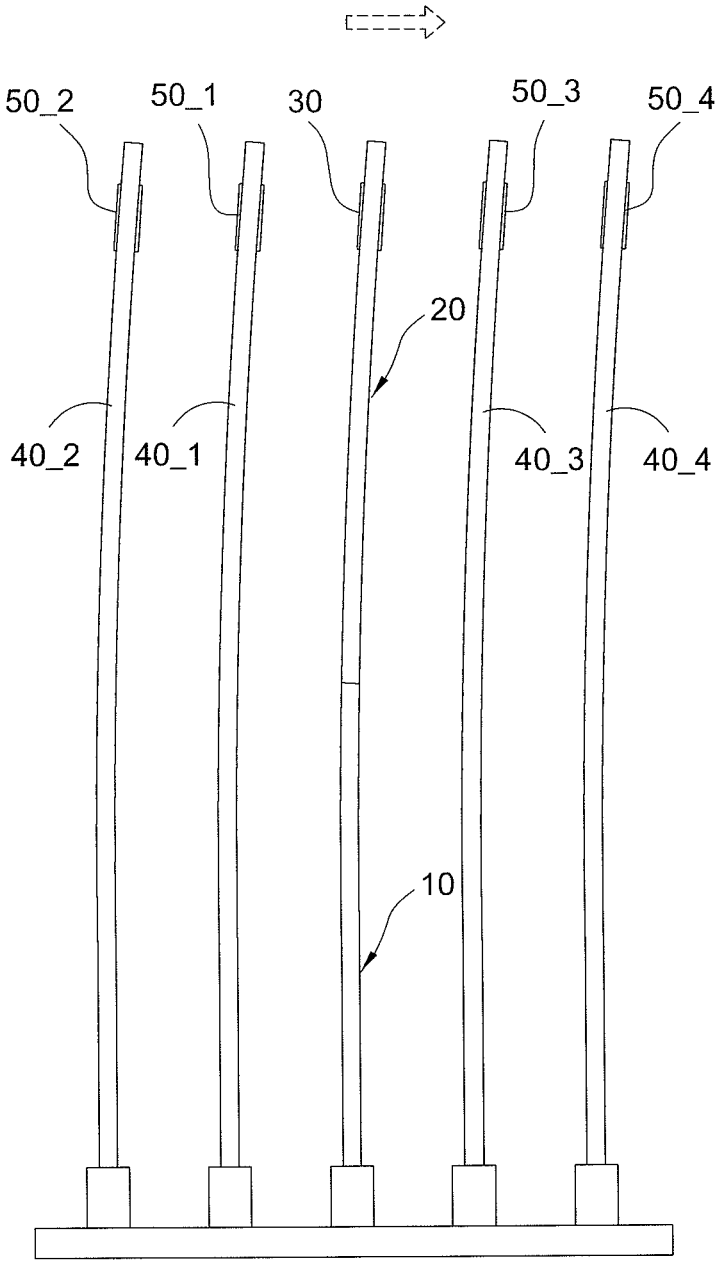
FIG. 3B is a schematic view of driving the magnetic-force interactive fan to swing toward the right according to the present disclosure.

Reference is made to FIG. 3A and FIG. 3B which are a schematic view of driving the magnetic-force interactive fan to swing toward the left and to swing toward the right according to the present disclosure, respectively. Continuing the above-mentioned descriptions, when the actuating portion 10 is driven to continuously swing by the AC power source, the main blade 20 connected to the actuating portion 10 is synchronously driven to swing. When the magnetic-force interactive fan stably and continuously operates and the main blade 20 swings toward the left (as shown in FIG. 3A), repulsive magnetic force produced between two adjacent magnets of the main magnet 30, the first interactive magnet 50_1, and the second interactive magnet 50_2 because the main magnet 30, the first interactive magnet 50_1, and the second interactive magnet 50_2 are correspondingly disposed to each other and the polarities of two adjacent magnets at the corresponding positions are opposite. Accordingly, the first interactive blade 40_1 and the second interactive blade 40_2 synchronously swing toward the same direction (left) with the main blade 20 because of repulsive magnetic force between the first interactive magnet 50_1 and the main magnet 30 and repulsive magnetic force between the second interactive magnet 50_2 and the first interactive magnet 50_1. In addition, the third interactive blade 40_3 and the fourth interactive blade 40_4 synchronously swing toward the same direction (left) with the main blade 20 because of elastic force produced from the main blade 20 and the third interactive blade 40_3 and the fourth interactive blade 40_4.

When the magnetic-force interactive fan stably and continuously operates and the main blade 20 swings toward the right (as shown in FIG. 3B), repulsive magnetic force produced between two adjacent magnets of the main magnet 30, the third interactive magnet 50_3, and the fourth interactive magnet 50_4 because the main magnet 30, the third interactive magnet 50_3, and the fourth interactive magnet 50_4 are correspondingly disposed to each other and the polarities of two adjacent magnets at the corresponding positions are opposite. Accordingly, the third interactive blade 40_3 and the fourth interactive blade 40_4 synchronously swing toward the same direction (right) with the main blade 20 because of repulsive magnetic force between the third interactive magnet 50_3 and the main magnet 30 and repulsive magnetic force between the fourth interactive magnet 50_4 and the third interactive magnet 50_3. In addition, the first interactive blade 40_1 and the second interactive blade 40_2 synchronously swing toward the same direction (right) with the main blade 20 because of elastic force produced from the main blade 20 and the first interactive blade 40_1 and the second interactive blade 40_2.

Afterward, the main blade 20 is driven by the actuating portion 10 to swing toward the left. Because of repulsive magnetic force produced between two adjacent magnets of the main magnet 30, the first interactive magnet 50_1, and the second interactive magnet 50_2 and elastic force produced from the main blade 20 and the third interactive blade 40_3 and the fourth interactive blade 40_4, the instantaneous movement of the magnetic-force interactive fan is shown in FIG. 3A. Afterward, the main blade 20 is driven by the actuating portion 10 to swing toward the right. Because of repulsive magnetic force produced between two adjacent magnets of the main magnet 30, the third interactive magnet 50_3, and the fourth interactive magnet 50_4 and elastic force produced from the main blade 20 and the first interactive blade 40_1 and the second interactive blade 40_2, the instantaneous movement of the magnetic-force interactive fan is shown in FIG. 3B. Accordingly, the main blade 20 and the interactive blades 40_1-40_4 are driven to synchronously swing to produce wind.

Figure 2B:
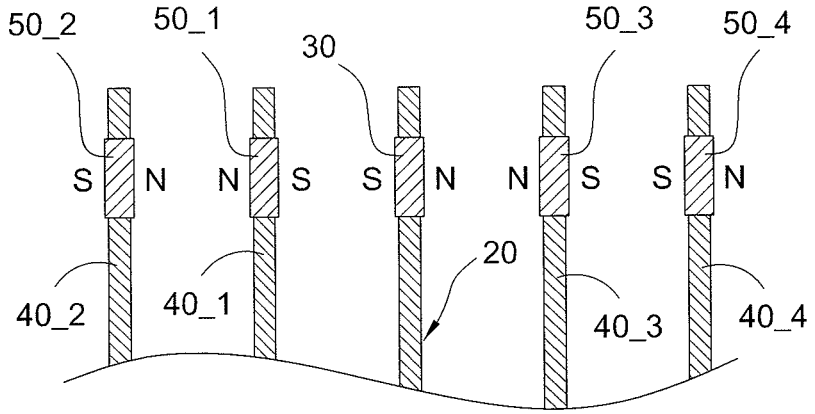
FIG. 2B is a partial schematic view of the magnetic-force interactive fan according to a second embodiment of the present disclosure.

In addition, reference is made to FIG. 2B which is a partial schematic view of the magnetic-force interactive fan according to a second embodiment of the present disclosure. The major difference between the second embodiment and the first embodiment is that the polarity of the main magnet 30 on left is S and on right is N in the second embodiment. Hence, the polarity of the first interactive magnet 50_1 on left is N and on right is S, the polarity of the second interactive magnet 50_2 on left is S and on right is N. Similarly, the polarity of the third interactive magnet 50_3 on left is N and on right is S, the polarity of the fourth interactive magnet 50_4 on left is S and on right is N. Because of repulsive magnetic force produced between two adjacent magnets of the main magnet 30 and the interactive magnets 50_1-50_4 and elastic force produced from the main blade 20 and the interactive blades 40_1-40_4, the operations of the magnetic-force interactive fan are similar to the above-mentioned first embodiment. Hence, the detail description is omitted here for conciseness.

Figure 4A:
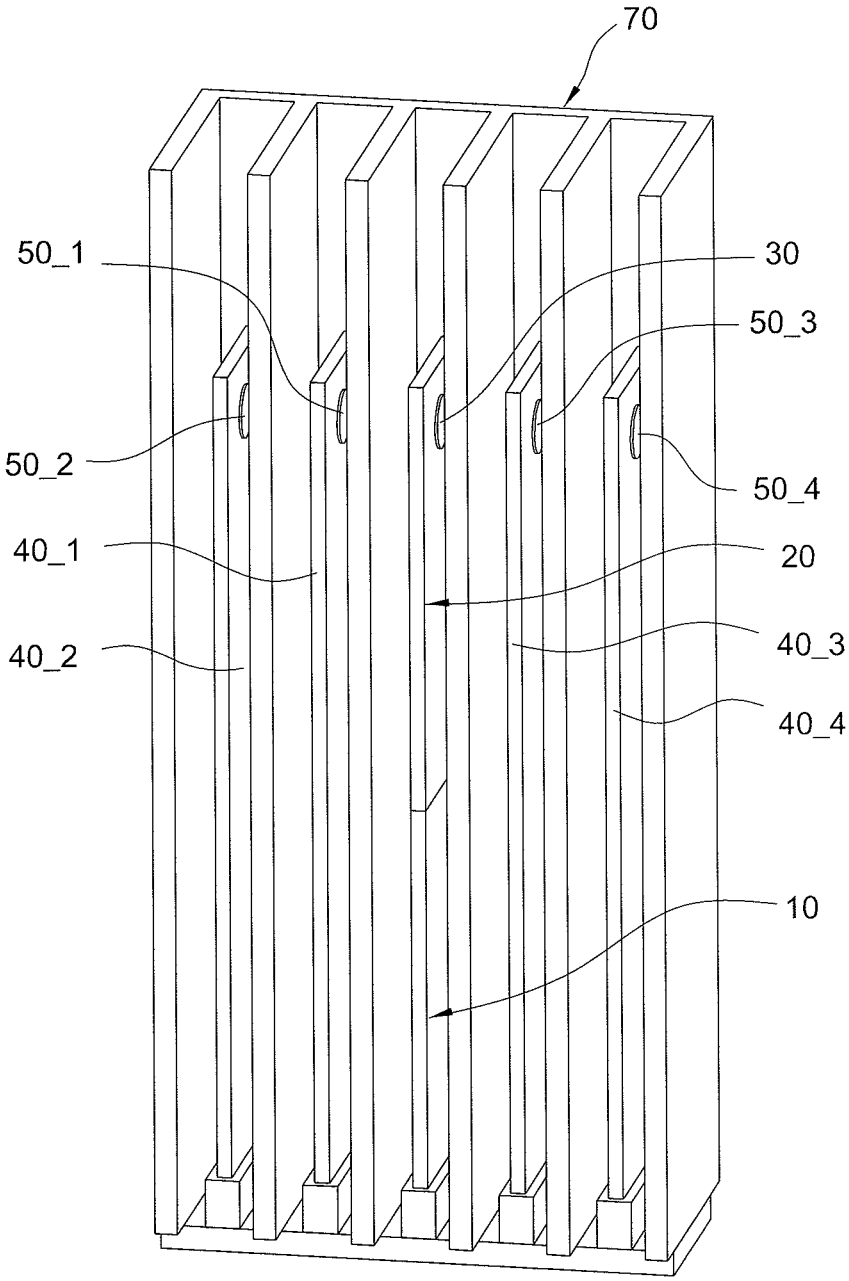
FIG. 4A is a schematic perspective view of applying the magnetic-force interactive fan to a heat-dissipating fin according to the present disclosure.
Figure 4B:
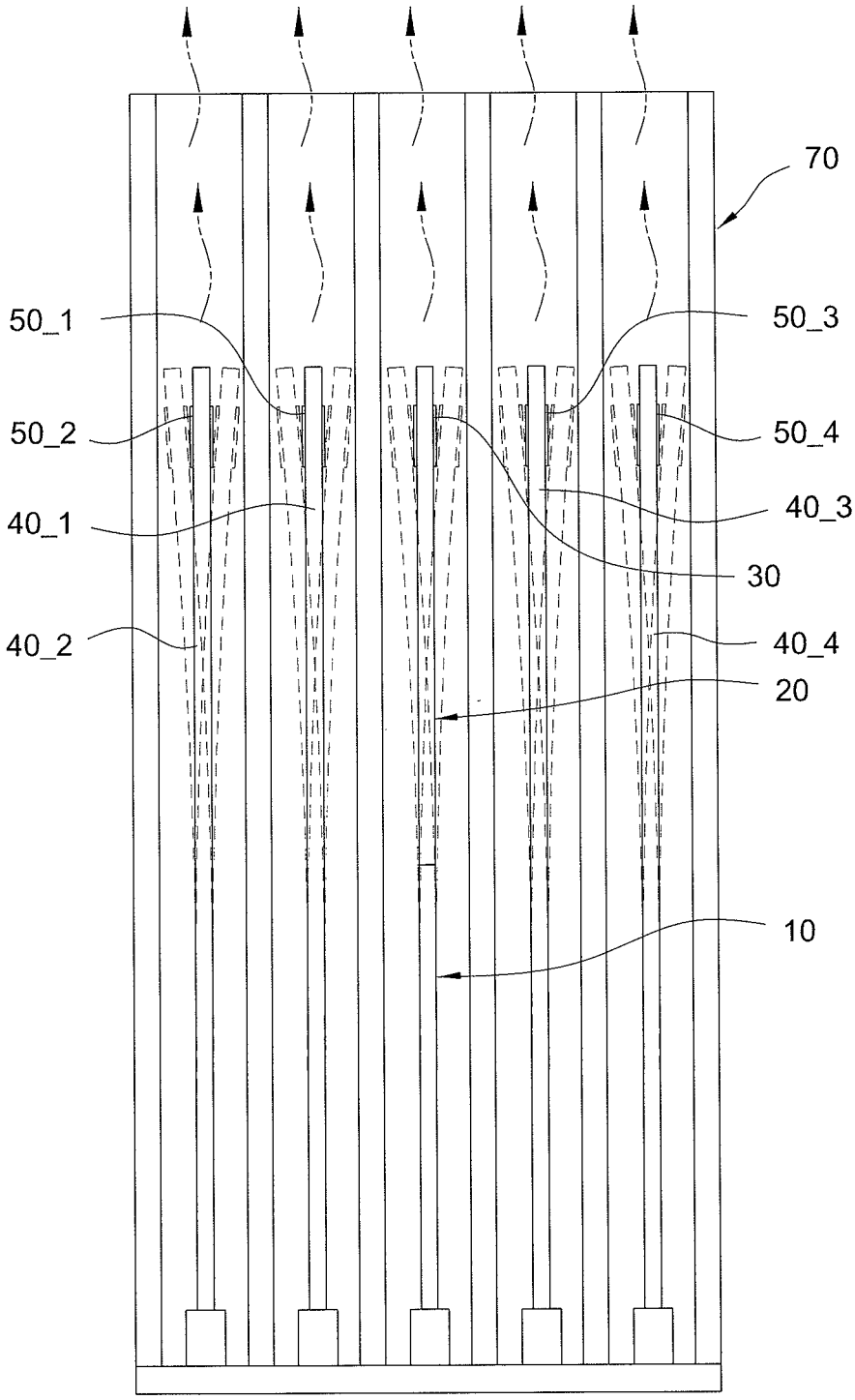
FIG. 4B is a schematic view of driving the magnetic-force interactive fan inside the heat-dissipating fin according to the present disclosure.

Reference is made to FIG. 4A which is a schematic perspective view of applying the magnetic-force interactive fan to a heat-dissipating fin according to the present disclosure. As shown in FIG. 4A, the magnetic-force interactive fan is combined with the heat-dissipating fin 70. The main blade 20 and the interactive blades 40_1-40_4 are installed in air channels of the heat-dissipating fin 70. Because the magnetic-force interactive fan is installed inside the heat-dissipating fin 70, the combination of the magnetic-force interactive fan and the heat-dissipating fin 70 does not increase occupied space. Reference is made to FIG. 4B which is a schematic view of driving the magnetic-force interactive fan inside the heat-dissipating fin according to the present disclosure. When the actuating portion (piezoelectric patch) 10 is supplied by the AC power source to provide a mechanical actuation, the piezoelectric patch continuously swings as the AC power source alternatively changes. Because of repulsive magnetic force produced between two adjacent magnets (including the main magnet 30 and the interactive magnets 50_1-50_4) and elastic force produced from the main blade 20 and the interactive blades 40_1-40_4, the main blade 20 and the interactive blades 40_1-40_4 synchronously swing to produce wind, thus providing heat-dissipating operations in air channels of the heat-dissipating fin 70. Especially, in this application, the maximum swinging width of each blade must be less than the width of the air channel of the heat-dissipating fin 70 so as to ensure the magnetic-force interactive fan can normally operate.

Figure 5A:
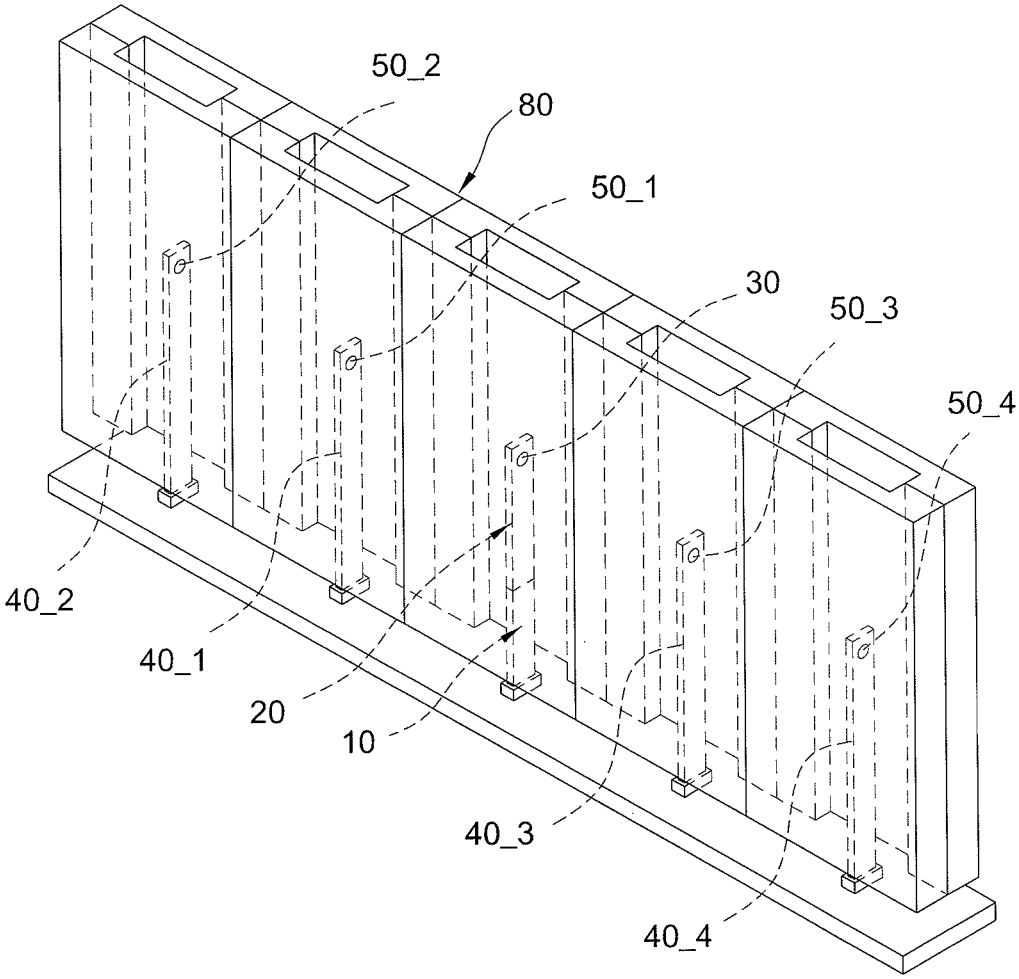
FIG. 5A is a schematic perspective view of applying the magnetic-force interactive fan to a fuel cell module according to the present disclosure.

Reference is made to FIG. 5A which is a schematic perspective view of applying the magnetic-force interactive fan to a fuel cell module according to the present disclosure. As shown in FIG. 5A, the magnetic-force interactive fan is integrated into the fuel cell module 80. The main blade 20 and the interactive blades 40_1-40_4 are installed inside air-inlet channels of stacked fuel cells. Because the magnetic-force interactive fan is contained inside the fuel cell module 80, the combination of the magnetic-force interactive fan and the fuel cell module 80 does not increase occupied space. Because the typical micro fuel cell has advantages of lower efficiency and lower output power, a fan is usually installed to overcome the above-mentioned disadvantages. However, the power consumption of the traditional rotary fan is a high proportion compared to the output power of the micro fuel cell so that the combination of the rotary fan and the micro fuel cell is inefficient.

Figure 5B:
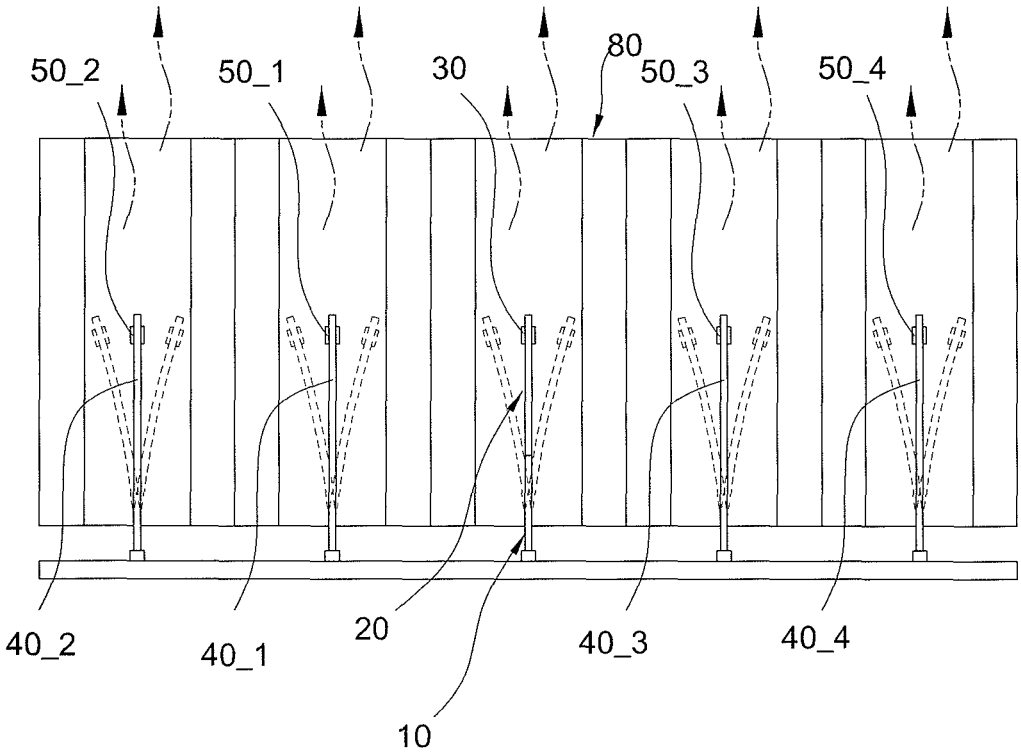
FIG. 5B is a schematic perspective view of driving the magnetic-force interactive fan inside the fuel cell module according to the present disclosure.

Reference is made to FIG. 5B which is a schematic perspective view of driving the magnetic-force interactive fan inside the fuel cell module according to the present disclosure. When the actuating portion (piezoelectric patch) 10 is supplied by the AC power source to provide a mechanical actuation, the piezoelectric patch continuously swings as the AC power source alternatively changes. Because of repulsive magnetic force produced between two adjacent magnets (including the main magnet 30 and the interactive magnets 50_1-50_4) and elastic force produced from the main blade 20 and the interactive blades 40_1-40_4, the main blade 20 and the interactive blades 40_1-40_4 synchronously swing to produce wind, thus providing heat-dissipating operations in air-inlet channels of the fuel cell module 80. Accordingly, the air inflow control and the moisture elimination in air-inlet channels can be implemented. Especially, in this application, the maximum swinging width of each blade must be less than the width of the air-inlet channel of the fuel cell module 80 so as to ensure the magnetic-force interactive fan can normally operate.

Especially, the actuating portion 10 of the magnetic-force interactive fan is not limited to be the piezoelectric element driven by the AC power source. As long as the actuating portion 10 can be driven to continuously swing, the main blade 20 is also can be driven by the actuating portion 10 to synchronously swing. In addition, repulsive magnetic force produced between two adjacent magnets (including the main magnet 30 and the interactive magnets 50_1-50_4) and elastic force produced from the main blade 20 and the interactive blades 40_1-40_4, the main blade 20 and the interactive blades 40_1-40_4 synchronously swing to produce wind.

To provide uniform swinging amplitude, the main blade 20 of the magnetic-force interactive fan is preferably installed in the middle position of the all blades (including the main blade 20 and the interactive blades 40_1-40_4). Also, the main magnet 30 is also disposed in the middle position of the all magnets (including the main magnet 30 and the interactive magnets 50_1-50_4). That is, when the amount of the main blade 20 and the interactive blades 40_1-40_N is odd, the main blade 20 forms a central axis and the interactive blades 40_1-40_N are symmetrically installed to the central axis in parallel. For example, if the magnetic-force interactive fan has the main blade 20 and four interactive blades 40_1-40_4, the main blade 20 is installed in the middle position of the all blades to form the central axis and the four interactive blades 40_1-40_4 are symmetrically installed to the both sides of the main blade 20 in parallel. When the amount of the main blade 20 and the interactive blades 40_1-40_N is even, the main blade 20 and an adjacent interactive blade form a central axis and other interactive blades are symmetrically installed to the central axis in parallel. For example, if the magnetic-force interactive fan has the main blade 20 and three interactive blades 40_1-40_3, the main blade 20 and the adjacent first interactive blade 40_1 form the central axis and other interactive blades 40_2, 40_3 are symmetrically installed to the both sides of the main blade 20 and the first interactive blade 40_1 in parallel.

To provide uniform swinging amplitude, the distances between two adjacent blades (including the main blade 20 and the interactive blades 40_1-40_4) are identical so that repulsive magnetic force produced between two adjacent magnets and elastic force produced from the main blade 20 and the interactive blades 40_1-40_4 are more uniform. However, this example is for demonstration and not for limitation of the present disclosure.

Furthermore, if the magnetic-force interactive fan is the magnetic-force interactive piezoelectric fan, the magnetic-force interactive piezoelectric fan can be operated at the resonance frequency, thus significantly reducing power losses of the magnetic-force interactive piezoelectric fan but providing sufficient swinging amplitude.

In conclusion, the present disclosure has following advantages:

1. Only one actuating portion (piezoelectric patch) 10 is provided to drive the main blade 20 with the main magnet 30 so as to synchronously drive the interactive blades 40_1-40_4 by the corresponding interactive magnets 50_1-50_4;

2. The piezoelectric element (such as the piezoelectric patch) is used as the actuating portion 10 and the elastic pieces (such as the PVC) are used as the main blade 20 and the interactive blades 40 so that the magnetic-force interactive fan has features of lower power consumption, lower noise, and longer use life; and 3. The magnetic-force interactive fan can be applied to heat-dissipating, heat-conducting, or airflow-controlling applications, thus achieving high combination without increasing occupied space.

Although the present disclosure has been described with reference to the preferred embodiment thereof, it will be understood that the present disclosure is not limited to the details thereof. Various substitutions and modifications have been suggested in the foregoing description, and others will occur to those of ordinary skill in the art. Therefore, all such substitutions and modifications are intended to be embraced within the scope of the present disclosure n as defined in the appended claims.

What is claimed is:

1. A magnetic-force interactive fan comprising:

a base;

a plurality of clamp portions separated to each other and installed on the base;

an actuating portion having a fixed terminal and a moveable terminal, the fixed terminal connected to one of the clamp portions;

a main blade having a free terminal and a connection terminal, the connection terminal connected to the moveable terminal of the actuating portion, the main blade further having a main magnet disposed on the free terminal thereof;

at least one interactive blade having a top terminal and a bottom terminal, the bottom terminal connected to another clamp portion, the at least one interactive blade further having an interactive magnet disposed on the top terminal thereof;

wherein the main magnet is disposed corresponding to the at least one interactive magnet and the main blade is driven by the actuating portion to swing, thus producing wind by synchronously swinging the main blade and the at least one interactive blade.

2. The magnetic-force interactive fan in claim 1, wherein the actuating portion is a piezoelectric element.

3. The magnetic-force interactive fan in claim 2, wherein the actuating portion is supplied by an alternating-current power source and configured to convert the alternating-current power source into a mechanical energy to provide a mechanical actuation.

4. The magnetic-force interactive fan in claim 1, wherein the main blade and the at least one interactive blade are an elastic piece, respectively, and the main magnet and the at least one interactive magnet are correspondingly disposed to each other and polarities of two adjacent magnets at the corresponding positions are opposite.

5. The magnetic-force interactive fan in claim 4, wherein the main blade and the at least one interactive blade synchronously and continuously swing through repulsive magnetic force produced between two adjacent magnets of the main magnet and the at least one interactive magnet and elastic force produced from the main blade and the at least one interactive blade.

6. The magnetic-force interactive fan in claim 1, wherein when the amount of the main blade and the at least one interactive blade is odd, the main blade forms a central axis; the interactive blades are symmetrically installed to the central axis in parallel.

7. The magnetic-force interactive fan in claim 1, wherein when the amount of the main blade and the at least one interactive blade is even, the main blade and an adjacent interactive blade form a central axis; other interactive blades are symmetrically installed to the central axis in parallel.

8. The magnetic-force interactive fan in claim 1, wherein the fixed terminal of the actuating portion is connected to one of the clamp portions by a locking means, an adhering means, or a clamping means.

9. The magnetic-force interactive fan in claim 1, wherein the bottom terminal of the main blade is connected to the moveable terminal of the actuating portion by an adhering means; the bottom terminal of the at least one interactive blade is connected to another clamp portion by a locking means, an adhering means, or a clamping means.

10. The magnetic-force interactive fan in claim 1, wherein the main magnet is fixed on the main blade by an embedding means or an adhering means; the at least one interactive magnet is fixed on the at least one interactive blade by an embedding means or an adhering means.

* * * * *